US008773032B2

(12) United States Patent
May et al.

(10) Patent No.: US 8,773,032 B2
(45) Date of Patent: Jul. 8, 2014

(54) LED LIGHT SOURCE WITH MULTIPLE INDEPENDENT CONTROL INPUTS AND INTEROPERABILITY

(75) Inventors: Dexter May, Vista, CA (US); Steven Schlanger, Flagstaff, AZ (US); Matthew Trotter, Cudahy, WI (US); Alex Walters, Butler, WI (US); Vincent Potenzone, Wauconda, IL (US); Lillian Cross-Szymanek, Santa Barbara, CA (US)

(73) Assignee: Thin-Lite Corporation, Camarillo, CA (US)

( * ) Notice: Subject to any disclaimer, the term of this patent is extended or adjusted under 35 U.S.C. 154(b) by 86 days.

(21) Appl. No.: 13/546,779

(22) Filed: Jul. 11, 2012
(Under 37 CFR 1.47)

(65) Prior Publication Data

US 2013/0162162 A1 Jun. 27, 2013

Related U.S. Application Data

(60) Provisional application No. 61/506,460, filed on Jul. 11, 2011.

(51) Int. Cl.
*H05B 37/02* (2006.01)

(52) U.S. Cl.
USPC ..... 315/224; 315/307

(58) Field of Classification Search
None
See application file for complete search history.

(56) References Cited

U.S. PATENT DOCUMENTS

| | | | | | |
|---|---|---|---|---|---|
| 5,374,852 | A * | 12/1994 | Parkes | 307/10.8 |
| 6,137,240 | A * | 10/2000 | Bogdan | 315/307 |
| 6,996,333 | B1 * | 2/2006 | Lin | 318/400.26 |
| 8,350,488 | B2 * | 1/2013 | Jin | 315/219 |
| 2009/0026958 | A1 * | 1/2009 | Kitagawa et al. | 315/77 |
| 2009/0267517 | A1 * | 10/2009 | Tanaka et al. | 315/82 |
| 2010/0327761 | A1 * | 12/2010 | Jin | 315/219 |

* cited by examiner

*Primary Examiner* — Crystal L Hammond
(74) *Attorney, Agent, or Firm* — Felix L. Fischer

(57) ABSTRACT

An LED lighting control system incorporating a control IC for fast control of LED current in a switching Buck-type power supply through dedicated power supply control hardware with slow changing signals of temperature and input under control of firmware. The control IC optimizes the use of power from the source and optimizes the operating efficiency of the LED output while providing for a plurality of LED devices to be powered in parallel by a single controller.

17 Claims, 9 Drawing Sheets

LED LIGHT SOURCE WITH MULTIPLE INDEPENDENT CONTROL INPUTS AND INTEROPERABILITY

REFERENCE TO RELATED APPLICATIONS

This application claims priority of U.S. provisional application Ser. No. 61/506,460 filed on Jul. 11, 2011 having the same title as the present application.

BACKGROUND

1. Field

This application relates generally to the field of lighting fixtures employing Light Emitting Diodes (LEDs) and more particularly to a LED fixture control system employing multiple independent control inputs.

2. Related Art

Generating visible light with LED light sources has disadvantages when compared to older technologies, such as incandescent or fluorescent light sources. When such LED lighting devices are powered from a low voltage DC source, for example in Automotive, RV, off-the-grid solar, Marine, then issues of cost, efficiency, control, and use are substantial obstacles to adoption. Low voltage LED lighting devices using state of the art design methods are expensive, inefficient, difficult to control, and are inflexible in their use.

The invention described herein uses new methods and a new architecture which combines a highly integrated microcontroller with a modular system of external devices to achieve a combination of high efficiency, low cost, high reliability, and operating features which are optimally suited to operation from a low voltage DC source.

SUMMARY

The invention discloses a new system architecture which uses a control IC which is a combination of a microcontroller and internal control logic which is operatively combined with inputs from a user, both local and remote.

In an example embodiment, a control IC provides fast control of LED current in a switching Buck-type power supply is controlled by dedicated power supply control hardware is combined with slow changing signals of temperature and input under control of firmware. The control IC optimizes the use of power from the source and optimizes the operating efficiency of the LED output while providing for a plurality of LED devices to be powered in parallel by a single controller.

In an example embodiment dimming of the LED output is controlled by the user, either by input from a momentary switch or from a wired or wireless control. Functional grouping of remotely controlled devices provides a system of dimming, set by the user, and grouped by device address. The dimming control is non-volatile, so that low voltage systems which are operatively designed to cut-off power may be returned to the state set by the user merely by restoring power, or by local or remote control.

Adding functions to the device is accomplished by plugging in Function Modules. These added functions are identified by an identification module in the Control IC which operatively changes the behavior of the device. Function Modules may include automated inputs such as a motion sensor, gas sensor, battery pack, etc.

The features, functions, and advantages that have been discussed can be achieved independently in various embodiments of the present invention or may be combined in yet other embodiments further details of which can be seen with reference to the following description and drawings.

DETAILED DESCRIPTION

Figure 1:
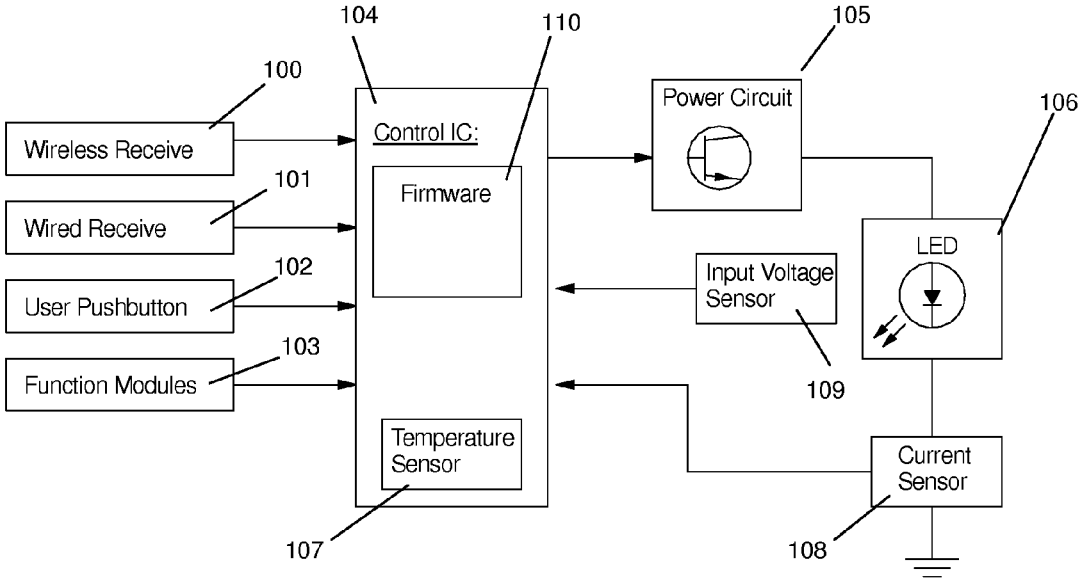
FIG. 1 is a block diagram of an example embodiment showing input devices, the control IC, sensors and LED with power switching.

An example embodiment for an LED control system employing the present invention is shown in FIG. 1. The system incorporates a controller having a control integrated circuit (IC) 104 which employs a combination of a microcontroller, non-volatile memory, and a power switching circuit 105 to be described with respect to FIG. 2. This combination completely and effectively eliminates a dedicated function LED or power supply controller IC. Control IC 104 accepts input signals from a plurality of user input sources which are uniquely and optimally suited for operation from a low voltage DC source.

Low voltage DC sources are often mobile, such as recreational vehicles (RVs) and marine applications. In mobile applications 12V power is available but the applications are space-constrained and as a result access to wiring and addition of new wiring is difficult. The control IC 104 therefore has an input for an wireless receiver module 100 which uses an ISM band RF link (for example 433 MHz) to allow a controlling device to operate the lighting device without the need for additional wiring circuits. A Manchester-encoded protocol is used in one exemplary embodiment to allow communication to occur using the wireless receive 100 module, to be described in greater detail subsequently, or a wired receive module 101 while using the same communication protocol. The wired receive module 101 is used when the communication may optimally occur over existing wires, for example power wires in a freight trailer.

Traditional lighting fixtures use an on-off switch. The device disclosed here uses a momentary switch as a user pushbutton 102 for the user to scroll through the various available operating modes. This feature allows the user to select a desired mode, for example a dimming level, then this mode is retained when the supplied power is turned off or turned off using a remote control means. The user of the device may therefore use the user pushbutton 102, a remote control via the wireless receive module 100, or the wired receive module 101 to select the operating mode of the device. For example, one lighting device may be installed under a cabinet with a 30% dimming level selected and another installed in an overhead position with 100% output. When the power is turned off both devices turn off. When the power is turned back on the devices return to their previous state selected by the user.

Figure 4:
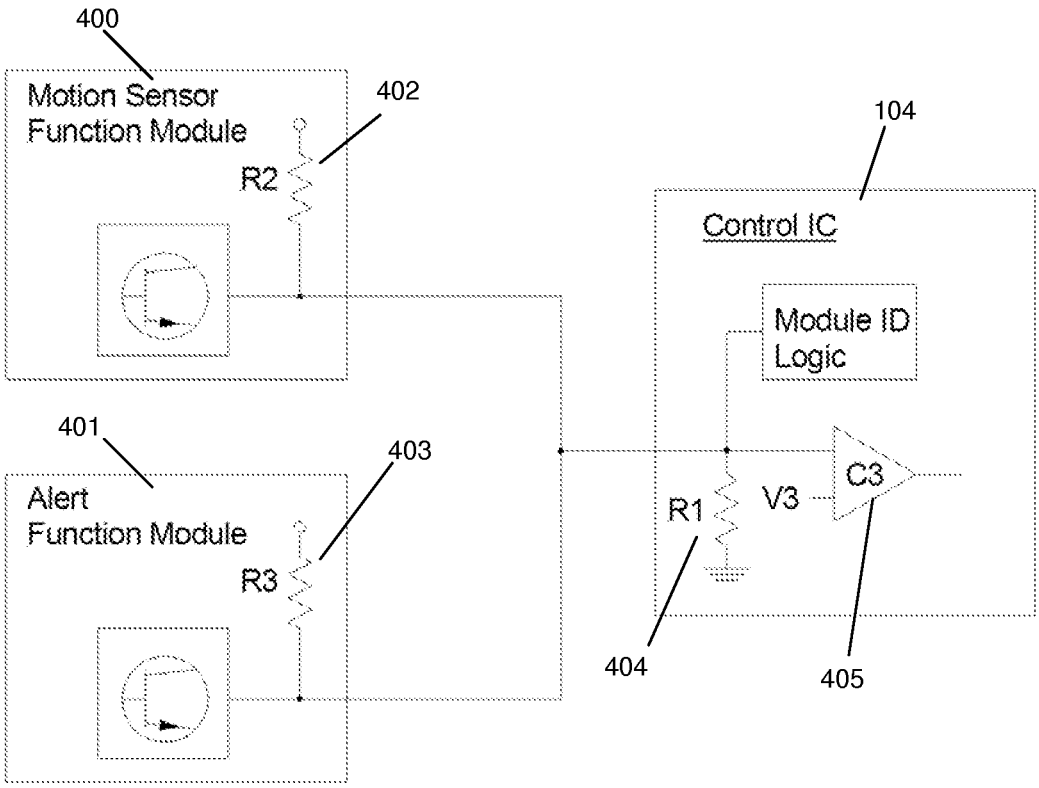
FIG. 4 is a block diagram of function module circuits and sensing logic in the control IC.

User inputs are connected to the device using a wireless connection system to be described in greater detail subsequently for the wireless communication module 100, a wired connection for the wired communications module 101, or the pushbutton 102 located on the device itself. In addition to the plurality of user inputs, the device accepts control inputs from automated sources. Function modules 103 may be plugged into the device, such as a motion sensor or alert sensors. An input with module identification control logic, as will be described in greater detail with respect to FIG. 4, is provided for the control IC 104 to identify the function module and adjust the output according to the function module type and the output signal.

High efficiency, reliable operation, and low cost are conflicting goals which the disclosed devices surpasses the current state of the art by using a unique architecture shown in FIG. 1. Control IC 104 uses embedded firmware (110 in FIG. 1) for providing operational routines to control on-board switching power supply logic which allows the control IC 104 to handle high-level communication and control tasks at low speed, while the on-board hardware runs the power devices driving the LED (or multiple LEDs in a string) at high speed without real-time supervision as will be described with respect to FIG. 2. Control IC 104 turns on a power switching circuit 105 which allows current to flow into an LED or array of LEDs 106. The current in LED 106 is monitored by a current sensor 108. The current sensor 108 provides a feedback signal to the control IC 104 in real-time. The invention disclosed here uses two other sensor inputs, temperature and input voltage, which are optimally combined with the current feedback signal to uniquely obtain reliable and efficient operation.

LED devices are sensitive to heat. A temperature sensor 107 is integrated with or directly into the control IC 104 to detect and adjust for failure modes or installation problems which may overheat the LED(s). For example, if the temperature exceeds a preset value of 80 Degrees C., or other value as deemed optimal for the application, the power to the LED would turn off until the temperature fails to a lower value. Alternatively, the output could be dimmed or flashed as a warning to the user that a fault condition exists.

The switching power supply changes its operating characteristics, for example the operating frequency, depending on the input voltage. The range of possible input voltage operating conditions is limited and depends on the type of power components used. The disclosed invention includes a input voltage sensor 109 which monitors the input voltage and adjusts the operation of the device. This adjustment of operation consists of changes to optimize the efficiency of the LED drive but also changes to optimally use the power supplied to the device.

There are a plurality of desirable behaviors which should optimally occur when the power input as sensed by the input sensor 109 shows that the input voltage is too low. In mobile applications, like RVs and Marine, the on-board battery must be preserved in order to maintain safe and reliable operation. If a lead-acid battery is discharged too deeply its life may be reduced or in freezing weather the battery would be immediately destroyed if over-discharged. The control IC (104) determines if the input sensor 109 shows an input which is too low. The control to the power switching circuit 105 and the LED 106 can be dimmed down when the input is marginal. At a low threshold the output is turned off altogether. Control IC 104 can also detect if an on-board backup battery is installed (as a function module) and a signal to the user, like a dimmed output or an occasional output dip, can be used to identify battery backup operation.

Control IC 104 contains circuitry dedicated to controlling the current into the LED without requiring real-time control of system firmware. This circuitry is described in detail starting in FIG. 2. Control of the output current is accomplished in this embodiment using, in this example, a resistor 209 as the current sensor, which generates a voltage proportional to the LED current that is fed into a pair of comparators 203 and 204 in control IC 104. In alternative embodiments, either constant current or constant voltage circuits may be employed. The control cycle begins when the device is first turned on and the LED current is 0. The voltage from resistor 209 is 0. Reference voltages V1 and V2 may be generated by circuitry internal to control IC 104 or externally. Comparator 204 sets its output high because the sensor voltage is less then threshold V2. The high output of comparator 204 sets the output of flip-flop 202. The output of Flip-Flip 202 is controlled by firmware in Control IC 104. Control IC 104 determines from a plurality of inputs, for example user settings, network commands, input voltage, temperature etc. if the LED should turn on. If a determination is made through the logic in control IC 104 that conditions are proper to run the LED then a switch 201 internal to control IC 104 closes. When switch 201 closes the output of flip-flop 202 is fed into a power switching circuit 105 which is external to control IC 104. This internal switch allows for a plurality of slow-speed decisions regarding user inputs and operating conditions to be optimally combined with the high-speed real-time control of the LED output. The internal switch 201 may also be viewed as a logical AND gate or similar device. Power switching circuit 105 employs a power switch 205, which may be a Bipolar Transistor, MosFet, or any semiconductor device with similar capability.

When power switch 205 turns on current will flow into an inductor 206. The current will increase and the voltage across resistor 209 will increase. When the voltage across resistor 209 rises above threshold voltage V1 then comparator 203 will set its output high. When the output of comparator 203 is high the output of flip-flop 202 will change to a low state. This low signal is fed through internal switch 201 to external power switch 205 which immediately turns off. When power switch 205 turns off the inductive effect of inductor 206 causes the voltage at the power switch 205 side of inductor 206 to fall below the ground potential whereupon diode 207 becomes forward biased and current continues to flow through inductor 206. While the power switch 205 is off the LED current will decrease until threshold V2 is reached and comparator 204 set it output high and the switching cycle begins again.

Figure 3:
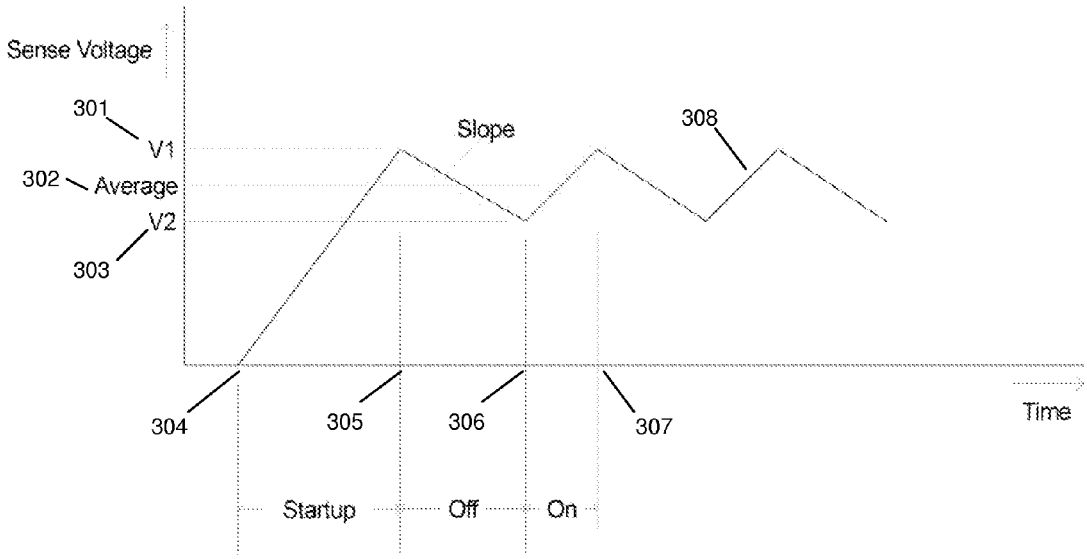
FIG. 3 is a graph of voltage control accomplished by the circuit of FIG. 2.

The timing of the switching cycle is shown in further detail in FIG. 3. When power switch 205 turns on at the time shown at 304 the voltage across resistor 209 begin to rise. The slope of this rise is equal to the input voltage divided by the inductance of inductor 206. When the current sense voltage rises to the value of threshold voltage V1 shown as 301 the power switch 205 turns off and diode 207 turns on and the current sense voltage falls. The slope of this falling current signal is equal to the LED forward voltage, plus the current times circuit resistance, divided by the inductance of inductor 206. If the LED forward voltage were the only factor then the off-time would be a constant value of LED forward voltage divided by inductance. When the falling current sense voltage reaches value 302 which is the threshold value V2 then power switch 205 turns on and the switching cycle repeats.

Control of the output current uses the topology of a Buck converter combined with an internal SR flip-flop (or equivalent function within the control IC) to allow a single control IC to optimally control the current into the LED 208. The threshold values monitored by comparators 203 and 204 effectively constrain the LED current to an average value 302, which is equal to the average value between the high threshold shown as 301 and the low threshold 302.

When the input voltage is very low, close to or less than the forward voltage of LED 106 then the power switch 205 may not turn off at all and the switching frequency is 0. When the input voltage is near its maximum the on time as shown by the interval between time 306 and 307 of FIG. 3 will be very short. The inductance value of inductor 206 is chosen so that at maximum input voltage the switching frequency does not exceed the maximum. As an example if a voltage of 20V is impressed across the inductor 206 then the current slope, measured in amps per second, will be equal to the voltage across the inductor divided by the inductance. In the case of an exemplary embodiment a value of 47 uH was chosen so that this slope is not more than 20V divided by 47 uH which equals 0.5 A per microsecond. The maximum operating frequency is limited only by the speed of comparators 203 and 204 and the switching losses of power switch 205. The switching frequency therefore may vary from 0 to the maximum value without any intervention by control IC 104.

Control IC 104 accomplishes dimming of the output by turning on and off the internal Switch 201 at a low frequency with a controlled duty cycle. For example, if a 30% output is required by the user then the internal switch 201 could be on for 3 milliseconds and off for 7 milliseconds.

A plurality of control inputs is provided for control IC 104 to process through operational routines contained in firmware 110 to decide if the LED should turn on an at what level of output. These control inputs include signals which may not involve a user. For example, it is advantageous for a light to turn on in an RV when a door is opened, or an external light to turn on if someone approaches. Other types of alerts may be needed, such as if the level of fuel or battery capacity falls below a threshold, or if water or gas, such as propane, is detected. The embodiment disclosed gathers the different input types including automatically generated signals to control the light source.

The system of generating such automated signals is shown in FIG. 4. Automated signals are gathered by a plurality of different function modules which are plugged into a connector. An example of a function module is a motion detector. Motion detectors are a well understood technology well known to anyone versed in the state-of-the-art. For the embodiment shown, the motion detector circuitry 400 incorporates an open-collector output which is pulled up by resistor R1 402. The output signal is fed into control IC 104. A pull-down resistor R2 404, which may or may not be internal to control IC 104, establishes a quiescent bias point which is between the power supply voltage and ground. This bias point equals the power supply voltage times R1/(R1+R2). This quiescent point is used to identify the function module, using logic internal to control IC 104 which uses comparator C3 405 to compare the bias point to a voltage internal to control IC 104. The example described here anticipates that only one function module will be plugged in at one time. The invention anticipates that multiple function modules may be used at one time by sensing a combination of the resistor values.

Control IC 104 detects that additional functions have been added when a function module 103 is plugged in by sensing that the input voltage is above ground potential. The identity of the function module depends on the value of the quiescent input voltage. The device then uses the identity of the function module to implement the appropriate operational routine from the firmware 110 to respond to signals from the function module. For example, if the function module is a motion detector then the signals from the function module may be ignored if the device is manually turned on by the user pressing the user switch 102, or sending a control signal through the wireless receiver 100 or wired receive 101. This would allow the user to override the automatic function when manual control is used. If, for example, the function module is a water or gas detector then the LED output may flash without a manual override.

An important type of function module is a battery pack. If control IC 104 identifies that a battery pack is installed then the behavior of the device would be modified, for example the maximum LED output, as set by the user, may be reduced and the minimum input voltage may be changed to allow for a lower voltage battery pack than the normal input low voltage cutoff.

Figure 5:
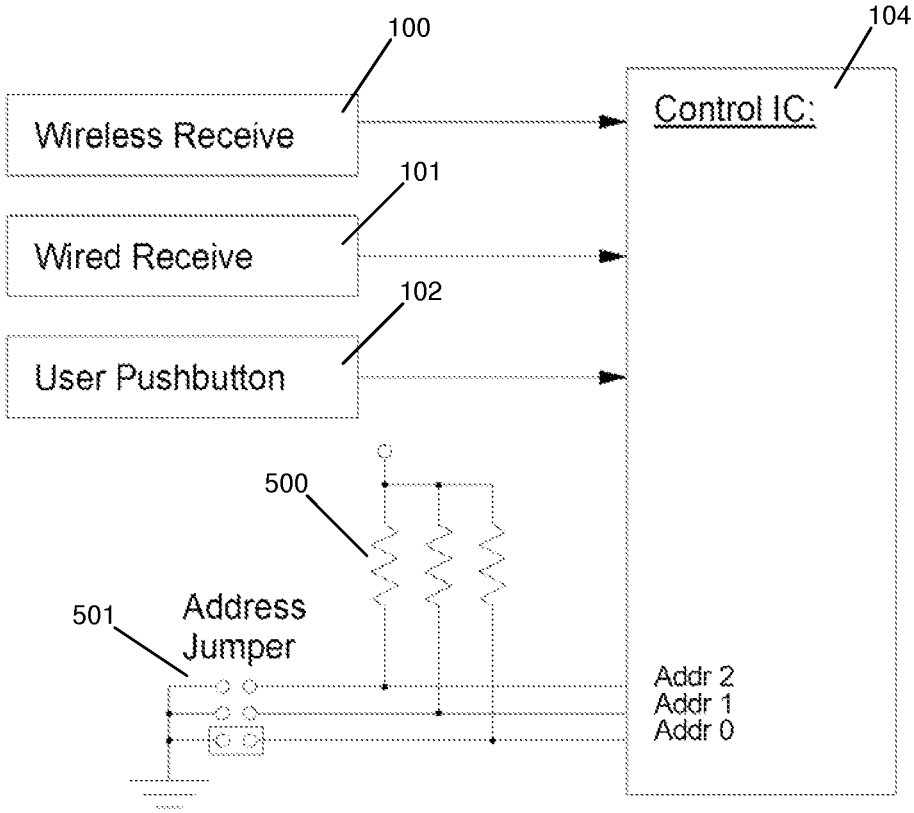
FIG. 5 is a circuit diagram of device addressing for use in the example embodiment.

The plurality of different types of user inputs provided as shown in FIG. 5. The user has access to a momentary Switch 102 as shown in FIG. 1. The momentary switch 102 is used to allow for a plurality of control signals to be operatively combined within firmware programmed into control IC 104. An input is provided for a wired network receive-only module 100 and a wireless receive module 101. The wireless receive module 100 is intended to be, but not limited to, a low-cost ISM band (i.e. 433 MHz) RF receiver. The wired receive module 101 is intended to be, but not limited to, a Manchester-encoded low-speed data protocol which is operatively identical to the RF protocol. The device address is set using jumpers 501 which are operatively combined with pull-up resistors to set the inputs of control IC 104.

Figure 8:
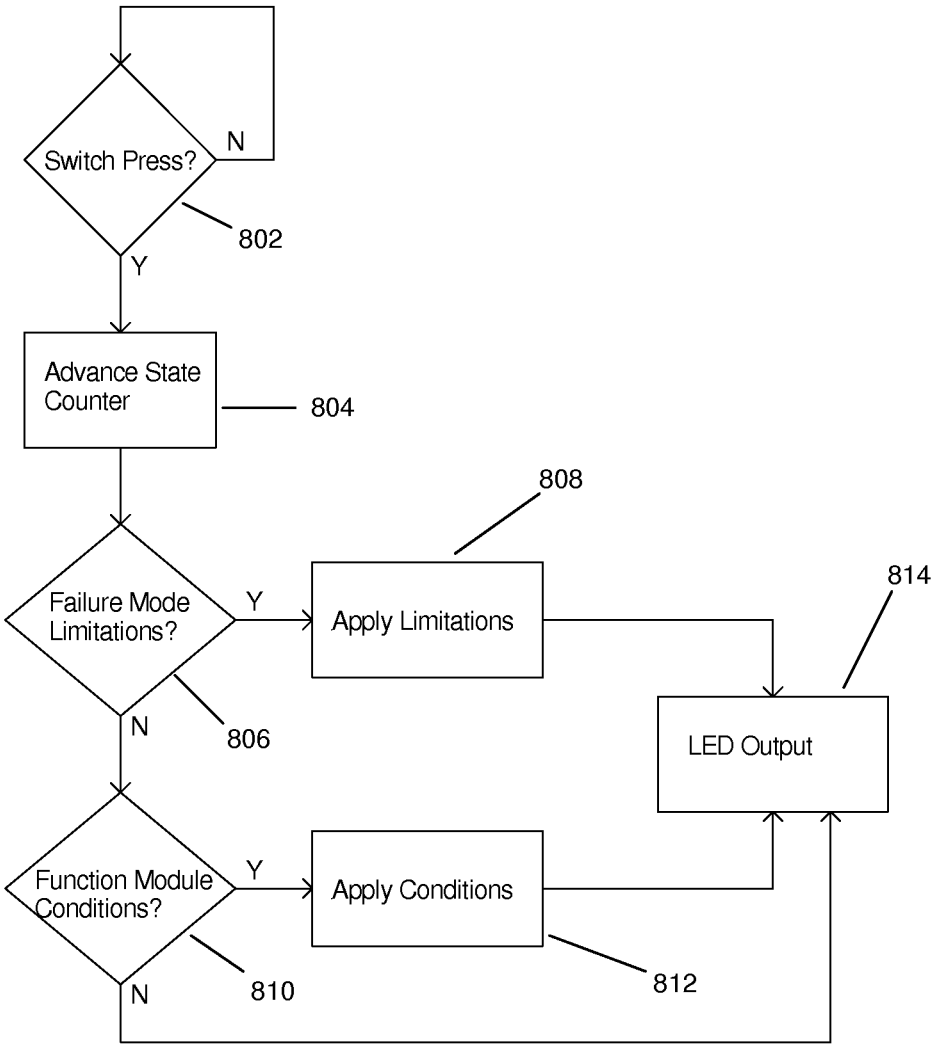
FIG. 8 is a flow chart depicting the of the operational routines of the control IC for operation of the LEDs in response to various control inputs.

FIG. 8 shows the how control IC (104) employs firmware operational routines 110 to act on a switch press, or a remote control equivalent thereof, to change the LED output. When a change to the LED output is requested by the user 802, the internal state counter is advanced 804. The new state may be a different level of dimming, a flashing state, or a state where the output color is changed. Control IC 104 first checks if any fault condition are present 806, such as high or low voltage input, or over-temperature fault from temperature sensor 107. For example, if the newly selected state calls for 50% dimmed output then if the input voltage is below a threshold then the Control IC 104 will apply limitations 808, for example the output may blink to indicate that an input fault exists. This blinking effect is a condition applied to the selected state.

If no fault exists then the LED output may optionally be modified if a function module (402 or 403) device is plugged in 810. For example, if a motion detector is plugged into the device the available states may be OFF, or ON, or Automatic, and in the Automatic state the LED light is under the control of the motion detector. When any condition relevant to the function of the added module (402 or 403) is applied 812 to the selected state the appropriate current is output to the LED 814.

A plurality of devices may use a device address to set their behavior using remote control, from wired or wireless control, to function as a group. For example, should the user wish to set aside Address 0 for lights which are external on an RV, then multiple devices would be set to Address 0 using the jumpers 501. Other devices may be used, for example as overhead lights as Address 1 and under-cabinet lights as Address 2. Thus the means of address selection is intended for the addresses of the devices to be NOT unique. The user would turn on each group of lights using a remotely mounted control where each switch on the remote control device would emulate a local switch press. Each switch on the remote control device corresponds to group of controlled devices which are set to the same address using the method shown in FIG. 5.

Figure 6:
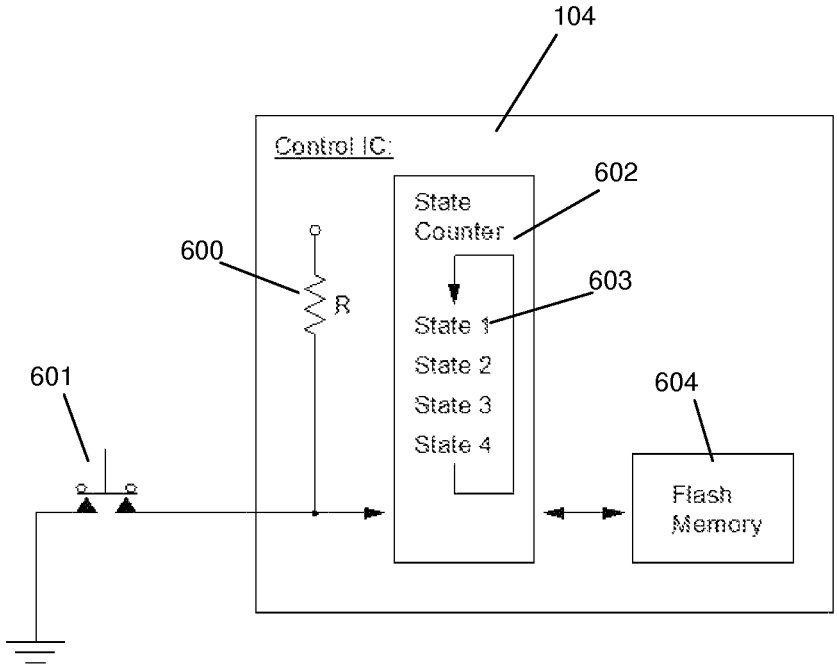
FIG. 6 is a block diagram of selection of and saving of operating states of the Control IC.

As shown in FIG. 1, a plurality of inputs from devices or modules are provided for sending commands to the device, including the wired receiver module 100, the wireless receiver 101, and the user switch 102. These external inputs from the user acts on the system as shown in FIG. 6. If, for example, the user switch 601, which may be a user pushbutton 102, wireless receive module 100, or wired receive module 101, is pressed, then a voltage is developed across a resistor 600 which is within control IC 104. This low voltage transition is then used to advance a state counter 602 which is maintained by firmware within the control IC 104. The order of states and the function within these states are controlled by a combination of the state selection by the user and the sensory inputs. For example, if 20% dim output is selected as State 1 603 then the device may display the 20% dim output, if the input voltage is valid and the temperature is normal. If the temperature is too high then the State 1 603 output may be 20% dim with an occasional flash, or other display means which will clearly signal to the user that some operating condition is faulty.

In this example subsequent presses of the user switch would advance the internal state counter 602 to its next state, until the last state is reached and subsequent switch presses would move the state counter 602 back to its initial state. The state counter has special states which are used in production and for test purposes which are not selectable by the user.

Control IC 104 has a flash memory storage 604 which is non-volatile, meaning that the contents of this memory are retained when power is turned off. When the state counter 602 changes state the contents are immediately saved to the flash memory 604. If power is turned off to the device then the previously selected state can be restored without user intervention. The restoration of the previous state optimally and uniquely provides for continuation of normal resumption of operation that the operator has selected, or from recovery from fault conditions that the operator can control or remediate.

Controlling power to the LED optimally uses high frequency signals because higher frequency devices are smaller and less expensive. The high speed control provided by the power switching circuit 105 as discussed with respect to FIG. 2 and FIG. 3 uses logic circuits internal to control IC 104. By separating the high-speed real-time control of the LED from slower events, such as user inputs, the control IC 104 is free to handle more complex functions. One such control function is dimming.

Figure 2:
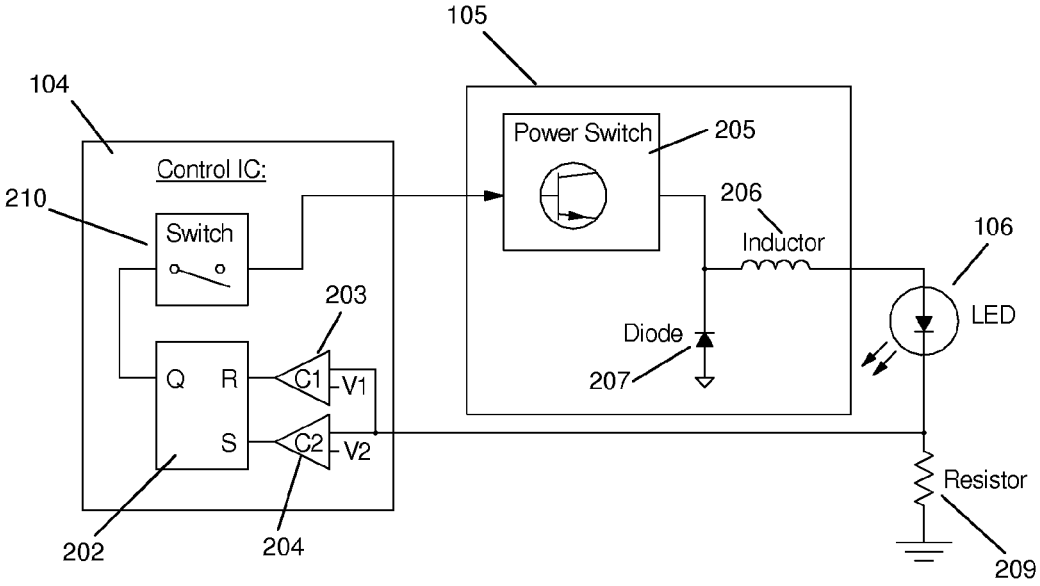
FIG. 2 is a block diagram detailing an example Buck converter with secondary control employed by the example embodiment.
Figure 7:
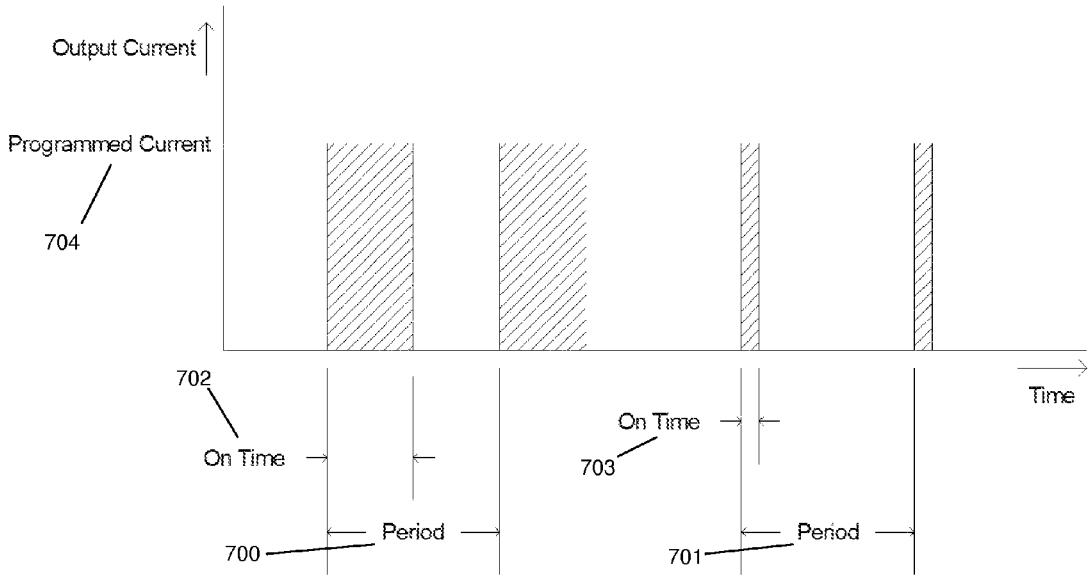
FIG. 7 is a graph depicting the LED dimming controlled by various operating states.

Dimming control of the LED output by control IC 104 is disclosed in FIG. 7. Control IC 104 turns on and off the LED power using the switch 210 within control IC 104 as shown in FIG. 2. Switch 210 can be turned off at any rate because this switch is not involved in the regulation of current to the LED. For example, the rate at which switch 210 is turned on and off may be any rate which does not result in a perceptible flicker.

FIG. 7 discloses two different amounts of dimming which results from a duty-cycle modulation of switch 210. When switch 210 is turned on then the output circuits will run and the current to the LED (106) will be set at the level shown graphically in FIG. 7 as the programmed current 704. Switch 210 is on for a given amount of time referred to as the on-time 702 resulting in the programmed current 704. Current to the LED 106 is then turned off. At some point the LED current is again turned on and the cycle repeats. The duty cycle is defined as the on-time 702 divided by the period 700. In the device disclosed here the duty cycle is equal to the dimming amount. For example, 50% dim is the same as a 50% duty cycle. FIG. 7 is drawn so that the on-time 702 divided by the period 700 is consistent with a 50% duty cycle.

The period of the current output to the LED 106 is set for a period as long as possible consistent with good appearance. This time is set optimally as long as possible to allow for as many higher functions to be processed concurrently by control IC 104 and short enough so that the LED 106 does not appear to flicker. Lights operated from AC power outside of the United States operate on a 100 Hz waveform whose period is 10 ms. Thus 10 ms was chosen as an example of a suitable period in within which the current to the LED may vary without perception by the user.

When the dimming level changes the device retains a constant period but the on-time varies. For example, if the duty cycle is changed to 10% from 50%, then the on-time (702) is increased but the period 700 remains the same so that the on-time 702 divided by the period 700 is 50% of the period 700. At the dimming setting of 10% the on-time 703 divided by the period 701 is 50%. This in this method the on-time 701 is the same amount of time as the on-time 700. FIG. 7 is drawn so that the on-time 703 divided by the period 701 is consistent with a 10% duty cycle.

Figure 9:
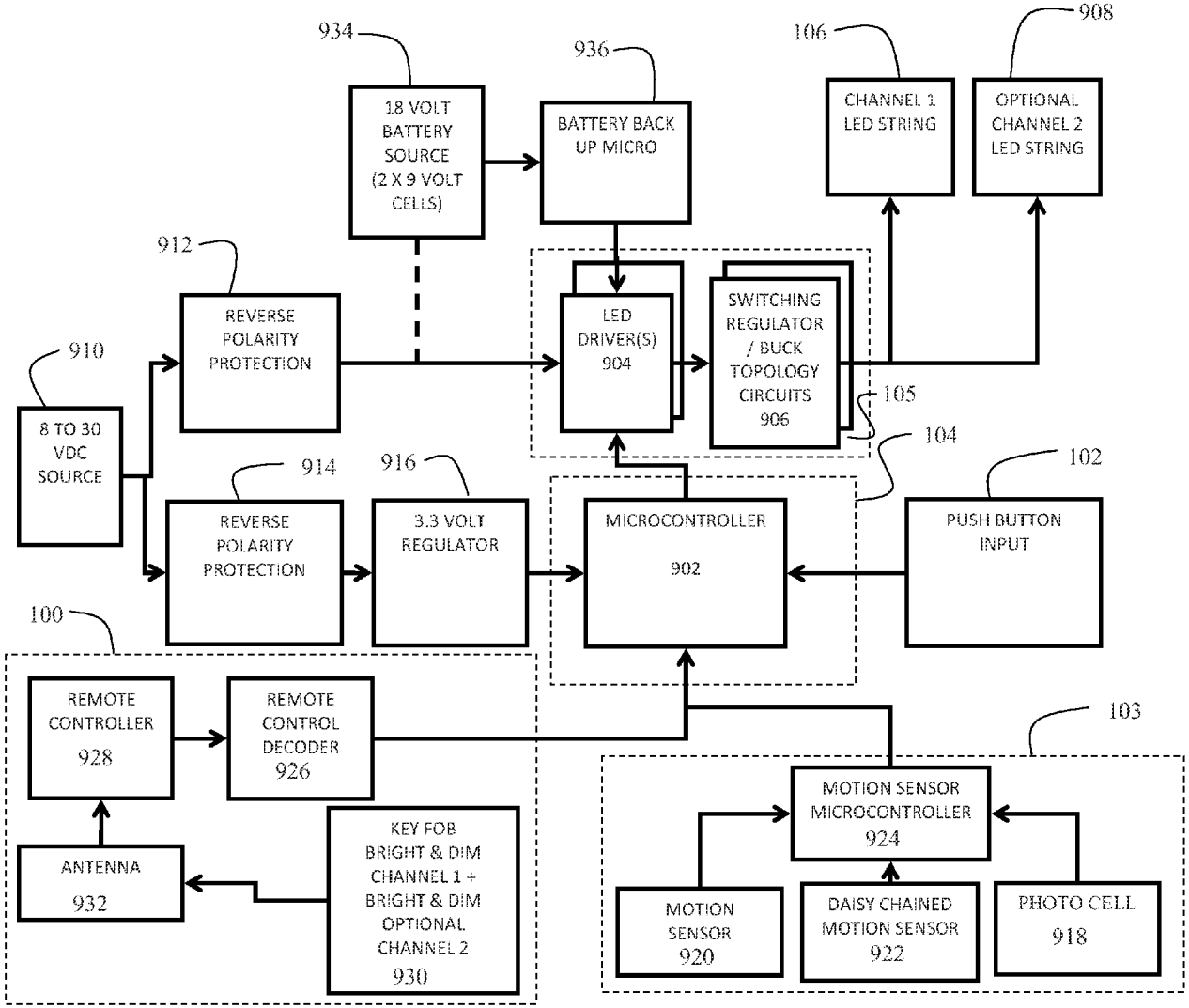
FIG. 9 is a block diagram of an example implementation of the system incorporating multiple control inputs.

A block diagram for an example implementation of the system is shown in FIG. 9. The control IC 104 is provided by a microcontroller 902 which may be a PIC16F1827 Flash Microcontroller produced by MicroChip Technology Inc. or a similar device. The microcontroller provides a PWM output signal for brightness control of the LEDs 106, as previously described, to the power switching circuit 105 which incorporates LED drivers 904 and associated switching regulator buck topology components 906 as previously described. In alternative embodiments, a boost regulator or Single-Ended Primary Inductance Converter (SEPIC) regulator may be employed. The LED driver may be a NCP2066 monolithic switching regulator produced by Semiconductor Component Industries LLC or similar device. For the embodiment shown, the power switching circuit may provide multiple channels of output for different LED arrays or strings with multiple LED drivers and switching regulator components. A second channel LED string 908 is shown as an example. Power for the system is provided by an 8-30 VDC source 910 which is connected through a first reverse polarity protection circuit 912 to the LED driver 904 to provide power for lighting the LEDs (106 and/or 908). Power from source 910 through a second reverse polarity protection circuit 914 and a 3.3 volt regulator/voltage reduction circuit 916 is connect to the microcontroller 902.

User operation of the system is controlled as previously described through a user pushbutton switch 102 or through function modules 103 or remote control module 100. For the embodiment shown, the function modules 103 include a photocell 918, a motion sensor 920 and a second daisy chained motion sensor 922 all of which provide input to a motion sensor microcontroller 924 that provides input to the microcontroller 902. A day-night sensor may be incorporated with the motion sensor to avoid activation of the LEDs during daylight hours when additional lighting is not required. In the example embodiment, the motion sensor microcontroller may be a RXM-418-LR RF receiver/controller produced by Linx Technologies Inc. The remote control module 100 incorporates a remote control decoder 926 which receives input from an input controller 928. The remote control microcontroller for the embodiment shown is a LICALI-DEC-MS001 micro decoder available from LINX Technologies Inc. In the example embodiment, the input controller may also be a RXM-418-LR RF receiver/controller. A keyfob input switch 930 with multichannel selection transmits through an antenna 932 to the input controller.

The embodiment shown additionally provides back-up power capability through a battery pack 934 which may comprise two 9V batteries connected for 18V output. A separate microcontroller 936 duplicating the functions of microcontroller 902 is connected to the LED driver 904 for operation in back-up mode.

Having now described various embodiments of the invention in detail as required by the patent statutes, those skilled in the art will recognize modifications and substitutions to the specific embodiments disclosed herein. Such modifications are within the scope and intent of the present invention as defined in the following claims:

What is claimed is:

1. A light emitting diode (LED) light source comprising:

an LED;

a controller having a plurality of control inputs with an internal switch for low speed control responsive to the control inputs; and, a power switching circuit responsive to the internal switch in the controller for high speed control of current to the LED.

2. The LED light source as defined in claim 1 wherein the plurality of control inputs are selected from the set of:

a momentary switch mounted on a case for the LED;

a remote switch;

an input voltage sensor; and, a temperature sensor.

3. The LED light source as defined in claim 2 wherein the remote switch is selected from the set of a wireless receive module and a wired receive module.

4. The LED light source as defined in claim 3 wherein the wireless receive module and wired receive module employ a Manchester-encoded protocol.

5. The LED light source as defined in claim 2 wherein the control inputs further comprise at least one function module, said controller incorporating an operational routine responsive to the function module.

6. The LED light source as defined in claim 5 wherein the controller further comprises module identification logic for selection of the operational routine.

7. The LED light source as defined in claim 5 wherein the at least one function module is selected from the set of a motion sensor, a water sensor, back up battery pack and a gas sensor.

8. The LED light source as defined in claim 1 wherein the power switching circuit comprises:

a power switch connected to the internal switch;

an inductor connected intermediate the power switch and the LED; and, a diode to ground connected intermediate the power switch and the inductor; and further comprising:

a current sensor detecting current through the LED and providing an output to a first comparator in the controller having an upper set point and a second comparator in the controller having a lower set point for modulation of the internal switch.

9. The LED light source as defined in claim 8 wherein said first comparator provides a reset to a flip-flop in the controller and the second comparator provides a set signal to the flip-flop, the flip-flop accomplishing high speed modulation to an input for the internal switch.

10. The LED light source as defined in claim 1 wherein the controller employs firmware supplying a plurality of operational routines providing the low speed control for the internal switch, said operational routines responsive to selected ones of said plurality of control inputs.

11. The LED light source as defined in claim 10 wherein dimming of the LED employs implementation of a selected operational routine for a duty cycle switching of the internal switch.

12. The LED light source as defined in claim 11 wherein the selected operational routine progresses through a plurality of states response to one of said plurality of inputs.

13. The LED light source as defined in claim 12 wherein each state is stored in a non-volatile memory.

14. The LED light source as defined in claim 1 wherein the controller further incorporates an address input and said controller is responsive to members of said plurality of control inputs corresponding to that address.

15. The LED light source as defined in claim 1 further comprising a plurality of jumper circuits connected to the address input for selection of at least one address.

16. A method for LED light source control comprising:

receiving a control input;

operating an internal switch responsive to the control input providing power through a high speed circuit having power switch responsive to the internal switch and connected through an inductor and a diode for current supply to an LED;

measuring current through the LED;

comparing measured current to a first threshold and upon reaching the first threshold providing a signal through the internal switch turning off the power switch;

comparing measured current to a second threshold and upon reaching the second threshold turning providing a signal through the internal switch turning on the power switch.

17. The method of claim 16 further wherein the step of receiving a control input establishes a state and further comprising:

storing the state in a flash memory; and reestablishing the state upon application of power.

* * * * *